United States Patent [19]

Hill

[11] Patent Number: 4,924,445

[45] Date of Patent: May 8, 1990

[54] SONOBUOY CABLE PACK

[75] Inventor: Murray O. Hill, Ingersoll, Canada

[73] Assignee: Her Majesty the Queen in Right of Canada as represented by the Minister of National Defence, Canada

[21] Appl. No.: 321,077

[22] Filed: Mar. 9, 1989

[30] Foreign Application Priority Data

May 26, 1988 [CA] Canada ..... 567751

[51] Int. Cl.[5] ..... H04B 1/59

[52] U.S. Cl. ..... 367/4; 367/3; 441/8; 114/326

[58] Field of Search ..... 367/3–5; 441/6–8, 21, 24–25, 33; 114/326, 328, 329, 330

[56] References Cited

U.S. PATENT DOCUMENTS

| | | | |
|---|---|---|---|
| 3,949,441 | 4/1976 | Menzel et al. . | |
| 4,272,835 | 6/1981 | Flood et al. | 367/4 |
| 4,464,130 | 8/1984 | Ouellette et al. | 367/3 X |
| 4,493,664 | 1/1985 | Dale | 441/7 |
| 4,631,709 | 12/1986 | Bender et al. | 367/4 |

*Primary Examiner*—Thomas H. Tarcza
*Assistant Examiner*—Tod Swann
*Attorney, Agent, or Firm*—Roylance, Abrams, Berdo & Goodman

[57] ABSTRACT

A sonobuoy comprising: a sonobuoy body; a main cable having a proximal end secured to the body and a distal end; a spool on which the cable is wound from the distal end toward the proximal end; and release means securing the spool to the body, and operative in response to immersion in water to release the spool from the body.

10 Claims, 2 Drawing Sheets

SONOBUOY CABLE PACK

The present invention relates to a sonobuoy and more particularly to a mechanism for deploying a hydrophone cable from a sonobuoy.

It is conventional practice with sonobuoys to provide the buoy with an outer housing that is jettisoned upon water entry. This allows for the release of a hydrophone and the cable connecting the hydrophone to the sonobuoy body. Elimination of the extra housing is desirable, particularly in very small size sonobuoys where space is at a premium. The objective of the present invention is to provide an alternative cable pack and release mechanism for a sonobuoy.

According to the present invention there is provided a sonobuoy comprising:

a sonobuoy body;

a main cable having a proximal end secured to the body and a distal end;

a spool on which the cable is wound from the distal end toward the proximal end; and release means securing the spool to the body, and operative in response to immersion in water to release the spool from the body.

On water entry, the release means acts to release the spool from the sonobuoy body, thus unwinding the main cable as the spool falls away from the body.

In preferred embodiments, a hydrophone is secured to the main cable by a lateral cable to provide a downrigger suspension for the hydrophone.

In the accompanying drawings, which illustrate an exemplary embodiment of the present invention:

Figure 1:
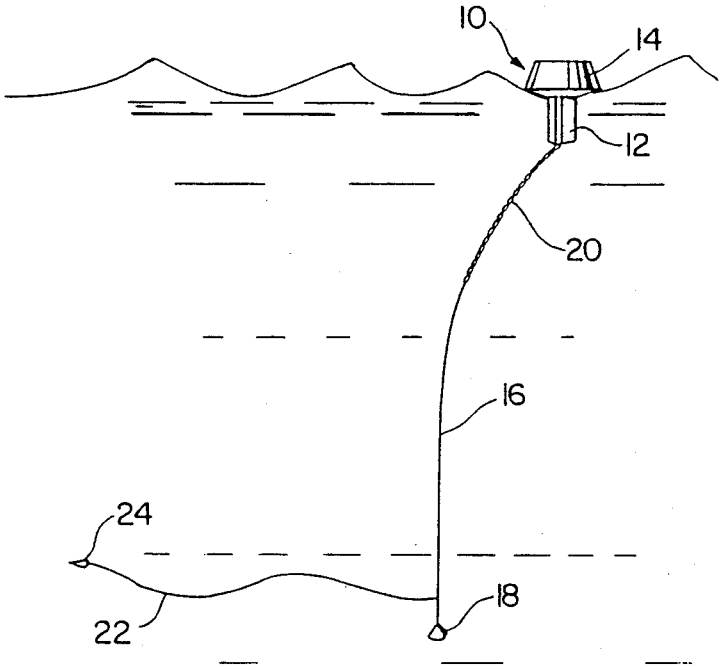
FIG. 1 is a pictorial representation of a sonobuoy according to the present invention in a deployed state.

Referring to the drawings, and particularly to FIG. 1, there is illustrated a sonobuoy 10 having a body 12 and a float 14. The sonobuoy is designed to float at the surface of a body of water as illustrated in FIG. 1. A main cable 16 has a proximal end secured to the body 12 of the sonobuoy 10 and a distal end connected to a spool 18 that acts, in the deployed state shown, as a ballast weight. Adjacent the body 12, the main cable 16 is paralleled by a compliance 20 that serves at least partially to isolate the main cable from wave induced motion of the body 12.

Adjacent the distal end of the cable 16 is a lateral cable 22 that is connected to a neutrally bouyant hydrophone 24. The effect of the combined main cable 16 with the ballast weight/spool 18 and lateral cable 22 is a downrigger type suspension for the hydrophone 24 that serves to isolate the hydrophone from wave induced motions of the body 12.

Before deployment of the hydrophone 24, the spool 18, cables 16 and 22 and compliance 20 are contained within a cable pack 26 mounted on the bottom end of the sonobuoy body 12. This is illustrated most particularly in FIG. 2. As shown, the sonobuoy 24 is contained within a recess 28 in the bottom of the body 12 and held in place by the spool 18 that is held on the bottom end of the body 12 by two release mechanisms 30.

Figure 2:
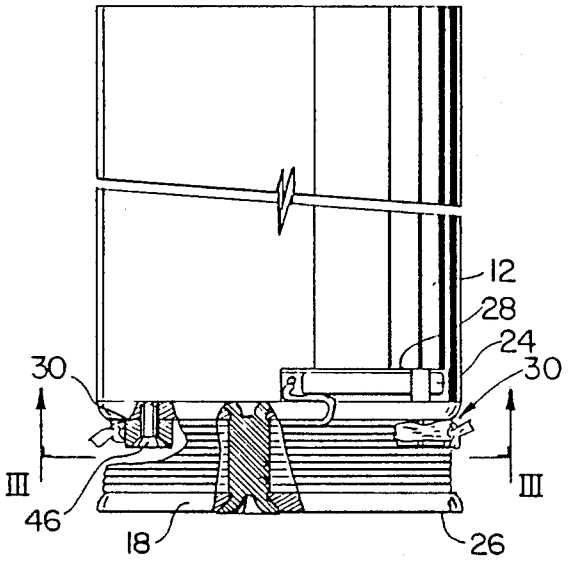
FIG. 2 is a side elevation of the sonobuoy before deployment.
Figure 3:
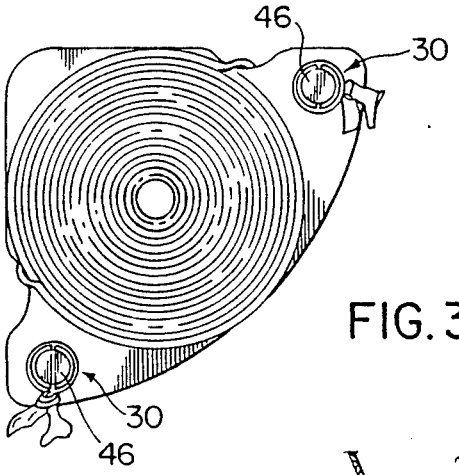
FIG. 3 is a view along line III—III of FIG. 2.
Figure 4:
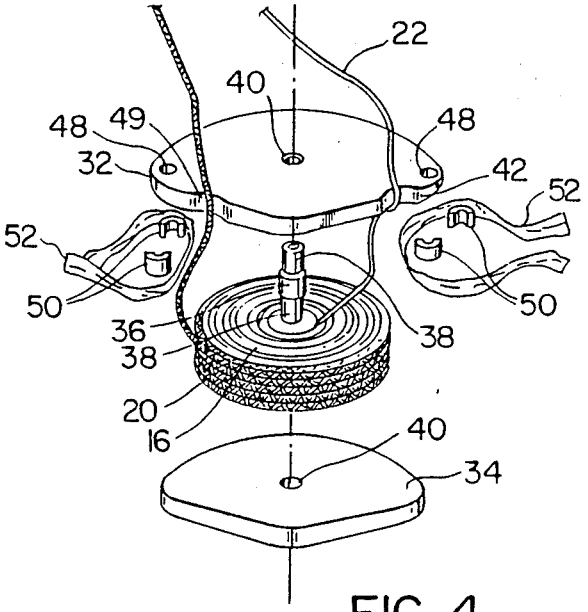
FIG. 4 is an exploded view of the cable pack of the sonobuoy.

As illustrated most particularly in FIG. 4, the spool 18 consists of an upper flange 32, a lower flange 34 and a core pin 36. The core pin 36 has hollow ends 38 that extend through respective bores in the flanges 32 and 34 and are riveted as illustrated in FIG. 2 to hold the flanges in place. As illustrated most particularly in FIG. 3, each of the flanges is configured as the 90° segment of a circle to match the configuration of the sonobuoy body 12.

The lateral cable 24 is connected to the hydrophone and passes around the upper flange 32, through a notch 42 for connection to the main cable 16, which is wound on the spool. The compliance 20 is wound on the spool together with the proximal section of the main cable 16. Both pass through a notch 44 in the edge of the upper flange 32 for connection to the sonobuoy body 12.

Figure 5:
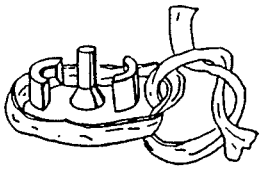
FIG. 5 is an exploded view of the release mechanism for the cable pack.

The release mechanisms retaining the cable pack on the sonobuoy body 12 are illustrated in FIGS. 2 through 5. These consist of retaining pins 46 secured to the body 12 and projecting through bores 48 in the upper flange 32. The pins 46 are headed with tapered heads as shown in FIGS. 2 and 5. Two retaining clips 50 are engaged with each of the pins 46. The clips are semi-cylindrical with an inner configuration matching the shape of the pin 46 and an outer diameter that is greater than the diameter of the holes 48. To retain the clips 50 in place, a strip of polyvinyl alcohol tape 52 is wrapped around the two clips and tied in a knot as illustrated in FIG. 5. The tape is water soluble so that upon water entry, the tapes dissolve, allowing the clips 50 to be jettisoned and the cable pack 56 to fall off the pins 46. The spool 18 then unwinds as it falls away from the sonobuoy body 12 to deploy the main cable 16 and ultimately the lateral cable 22 and hydrophone 24. The hydrophone is released from its recess 28 in the bottom of body 12 when the spool drops off the pins 46.

While one embodiment of the present invention has been described in the foregoing, it is to be understood that other embodiments are possible within the scope of the present invention. For example, the described embodiment incorporates the use of two release mechanisms, each including a retaining pin, a pair of retaining clips and a strip of PVA tape. In other embodiments, other numbers of these components can be used, for example a single pin 46 and one or more retaining clips 50. It is also possible to construct a release mechanism that will release on impact with the water or that uses only a water soluble release mechanism.

The embodiments of the invention in which an exclusive property or privilege is claimed are defined as follows:

1. A sonobuoy, comprising:

a sonobuoy body;

a main cable having a proximal end secured to the body and a distal end;

a spool on which the cable is wound from the distal end toward the proximal end; and release means, securing the spool to the body and operative in response to immersion in water, for releasing the spool from the body, the release means including at least one pin secured to the body and extending into an opening in the spool, and retainer means for releasably securing the pin in the opening, the retainer means including retaining clips engageable with the pin and a water soluble band holding the clips in engagement with the pin.

2. A sonobuoy according to claim 1, including a compliance cord secured to the body and to the cable at a location spaced from the proximal end.

3. A sonobuoy according to claim 1, including a lateral cable connected to the main cable intermediate its ends and a hydrophone secured to the lateral cable, the lateral cable being wound on the spool with the main cable.

4. A sonobuoy according to claim 3, wherein the spool is secured to the distal end of the main cable.

5. A sonobuoy according to claim 4, wherein the spool comprises a ballast weight.

6. A sonobuoy according to claim 1, wherein the band is a polyvinyl alcohol tape.

7. A sonobuoy according to claim 1 wherein the opening has greater transverse dimensions than the pin.

8. A sonobuoy according to claim 7 wherein the retaining clips, when coupled to the pin by the band, have greater transverse dimensions than the opening.

9. A sonobuoy according to claim 8 wherein the retaining clips are semi-cylindrical.

10. A sonobuoy according to claim 9 wherein the pin comprises a tapered head.

* * * * *